US006568057B2

(12) United States Patent
Okeda et al.

(10) Patent No.: US 6,568,057 B2
(45) Date of Patent: May 27, 2003

(54) ROLLER BURNISHING TOOL

(75) Inventors: Shinichi Okeda, Uozu (JP); Hideaki Okajima, Uozu (JP); Kouki Watabe, Uozu (JP)

(73) Assignee: Sugino Machine Limited, Toyama (JP)

( * ) Notice: Subject to any disclaimer, the term of this patent is extended or adjusted under 35 U.S.C. 154(b) by 0 days.

(21) Appl. No.: 09/898,722

(22) Filed: Jul. 3, 2001

(65) Prior Publication Data

US 2002/0046451 A1 Apr. 25, 2002

(30) Foreign Application Priority Data

Oct. 24, 2000 (JP) ..... 2000-323758

(51) Int. Cl.[7] ..... B21C 37/30
(52) U.S. Cl. ..... 29/90.01
(58) Field of Search ..... 29/90.01; 72/122, 72/123, 125

(56) References Cited

U.S. PATENT DOCUMENTS 3,656,333 A * 4/1972 Kruse, Jr. ..... 29/90.01
3,751,781 A * 8/1973 Koppelmann ..... 29/90.01
3,818,559 A * 6/1974 Benson ..... 29/90.01
4,380,851 A * 4/1983 Dickinson ..... 29/90.01
5,247,819 A * 9/1993 Morimoto et al. ..... 72/122

FOREIGN PATENT DOCUMENTS

JP 64-275 1/1989

* cited by examiner

*Primary Examiner*—David P. Bryant
(74) *Attorney, Agent, or Firm*—Merchant & Gould P.C.

(57) ABSTRACT

To provide a roller-burnishing tool, for installing in a small machining center, small NC lathe and so forth. The frame for rolling compaction processing is coaxially connected with the shank portion which performs a rotary drive by mounting in a driving machine, and the mandrel is supported by this frame with a universal function for rotation. A tip end of the mandrel and the multiple rollers are formed into a taper shaped style for being supported for rotation from a radial direction. The mandrel and the compressing coil spring, which functions from the shank portion side to the frame side are provided in the shank portion as well as the adjustable ring, which allows adjustment of tool diameter by moving the position of the mandrel in an axial direction relative to the frame.

4 Claims, 5 Drawing Sheets

ROLLER BURNISHING TOOL

BACKGROUND OF THE INVENTION

1. Field of Invention

The present invention relates to a roller-burnishing tool to process an inner surface of a work hole, and more particularly to a roller-burnishing tool to finish inner holes of small parts in the wide range of fields such as automobile, home electronic appliance, semiconductor and so forth by a rolling compaction of multiple rollers.

2. Prior Art

A roller-burnishing tool, for example, such as the like indicated in Japanese Utility Model Publication No. 64-275 is common. FIG. 1A and FIG. 1B illustrate this kind of roller-burnishing tool 111. The multiple rollers 113,113 to carry out a rolling compaction processing of an inner work hole W1 of a work W are engaged in a tip of an outer circumference of the cylindrical frame 112 with universal function for rising and setting and rotating, and the mandrel 114 formed as transmitting a rotary driving force is imbedded in said frame 112 with rotary supporting of these rollers 113 from the center axis of the frame 112. This structure imparts a rotary driving to this mandrel 114 through the shank 115 by a driving machine such as a machine tool, a rotary drill and so forth.

In said roller burnishing tool 111, when the diameter (hereinafter called tool diameter) of the enveloping circle of multiple rollers 113,113 for the internal diameter of the work hole W1 is adjusted, the mandrel 114 is moved by screwing forward or backward along screw hole 117 processed on the rear of the housing parts 116 connected with an outer diameter of said frame 112, and the degree of rising and setting of each of rollers 113 for the outer circumference of frame 112 is adjusted by changing the position of contact of the taper shaped mandrel 114 with each roller 113.

In this way, however, the structure for positioning the mechanism outside frame 112 to adjust a tool diameter is not applicable for effective downsizing and lightening since the compression and downsizing of tool length has an automatic limitation.

Accordingly, in this kind of roller-burnishing tool, the protruding length of a tip side of the frame 112 and the housing part 116 is automatically longer than the shank 115, so the usage for installing in a miniature type of machining center and NC lathe and so forth is not feasible.

In addition, the method of driving rollers 113, 113 by transmitting the rotary driving of the mandrel 114 can not obtain a floating function even though a clearance in the radial direction is set between the mandrel 114 and the frame 112.

Hence, this can not be sufficiently applicable for an eccentricity of a work hole. In addition, the improvement of an efficient rapid rotation is difficult since the tool rigidity is low due to the structure of imparting a rotary drive to a detailed mandrel 114 positioned along an axis of the frame 112.

Moreover, when tweaking a tool diameter, the position of the rollers 113,113 is also moved due to the structure of adjusting a tool diameter by moving the frame 112 in an axial direction. Whenever this is done, a readjustment of stroke in the driving machine is indispensable which has been a shortcoming. The purpose of the present invention is to solve these shortcomings.

SUMMARY OF THE INVENTION

The present invention provides a roller-burnishing tool, which includes a cylindrical frame for a rolling compaction processing. The frame is coaxially connected with a cylindrical shank portion, which mounts to a rotary driving machine. The multiple rollers for rolling compaction processing are formed in a radial direction along this frame with universal function for rising and setting, and the grooves to engage said rollers are formed in circular direction at regular intervals along this frame with universal function for rotation. The rollers engage said grooves. The multiple rollers contact the taper shaped mandrel which provides support for rotation. The mandrel is fitted into said shank portion and frame with universal function for rotation. An adjustable mechanism is provided to adjust tool diameter by moving mandrel position in an axial direction relative to said frame an elastic mechanism in said shank portion to stimulate said mandrel from the shank portion side toward the frame side.

Another embodiment of the roller-burnishing tool provides, when reversing the rotation of said frame from a processing direction, to allow a tip of said mandrel to move from said frame side to said shank side, a feed angle is provided in both said grooves of said frame and the rotation axis of said rollers engaged in said grooves.

Still another embodiment of the roller-burnishing tool provides clearance between an outer circumference of said mandrel and an inner surface of said frame to allow this mandrel to float.

In the first embodiment, when inserting said frame into the work holes with normal rotation drive, each roller contacts with a tip taper shaped mandrel and begins to revolve by relative friction force generated in between. Each roller dependently rotates in accordance with the rotation of the frame since the mandrel is free from a rotary direction by being supported in a freely rotatable condition. The rolling compaction force of a roller for an inner work hole depends upon the gap between tool diameter and diameter of the work hole. As a result of driving the frame, the rollers perform a rapid feeding processing by the principle of planetary motion compared with the structure of driving a conventional mandrel. As a result of coaxially positioning the mandrel along the center axis of the frame improves rotational accuracy which leads to a capability for a rapid rotation, and moreover, coaxially connecting the frame with the shank portion of the rotary drive improves rotational accuracy which allows the rollers to perform rapid rotation with high accuracy. Hence, efficiency is significantly improved compared with a conventional one.

With respect to the second embodiment, when reversing the rotation of said frame, a retreat force is generated in the mandrel by the agency of a feed angle., the tool diameter is shrunk when this retreat force exceeds the impetus force of said elastic mechanism. Accordingly, by reversing the rotation of the frame, it becomes possible to easily withdraw the frame from a work hole. The feed angle is provided in each groove for engaging rollers. Imparting normal rotary motion to the frame keeps the tool diameter to an initial set value. When retreating, reversing the rotation of the frame causes the taper shaped mandrel to move backward to the shank portion and each roller moves inwardly in a radial direction. Hence, tool diameter is shrunken, and quick withdrawing becomes practical. When the frame is withdrawn from inside a work, the tool diameter returns to an initial state by accumulated impetus of the elastic mechanism imbedded in the shank portion.

Moreover, with respect to the third embodiment, since the mandrel is floating in a radial direction due to the clearance between inner surface of the frame and the mandrel, processing accuracy is sustainable even under the condition of establishing a tool diameter on the position slightly slipped from the center of the work hole.

BRIEF EXPLANATION OF THE DRAWINGS

FIG. 1 illustrates the conventional example, where

FIG. 2 illustrates the roller-burnishing tool of this invention, where

DETAILED EXPLANATION OF THE PREFERRED EMBODIMENTS OF THE INVENTION

Figure 1A:
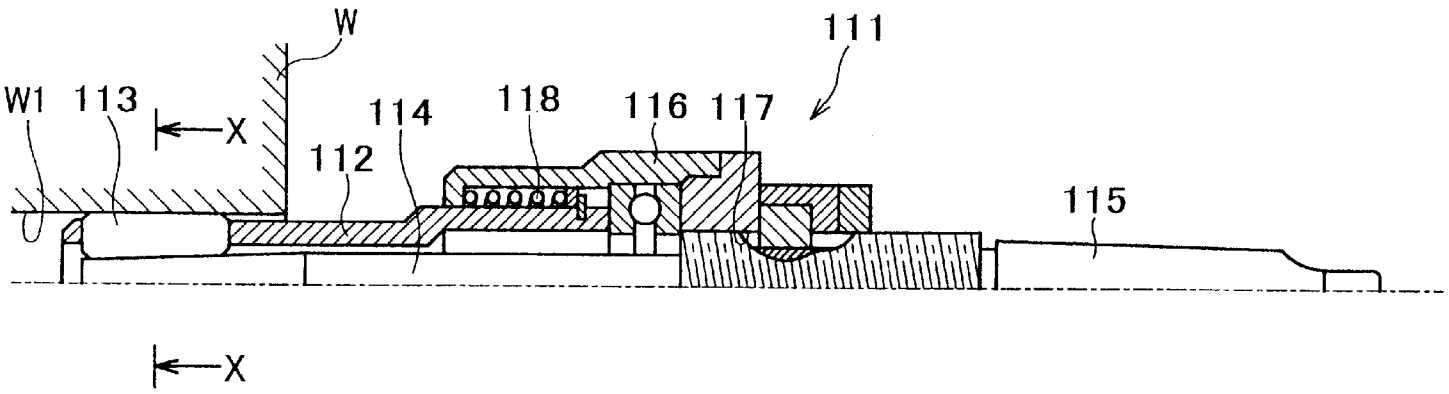
PRIOR ART FIG.1A
FIG. 1A illustrates a half-sectional view of the roller-burnishing tool and FIG. 1B illustrates a tip of the mandrel, the X—X sectional view of FIG. 1A indicating a contact condition of the roller with the frame.
Figure 1B:
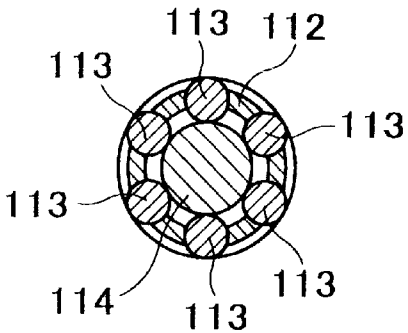
Figure 2A:
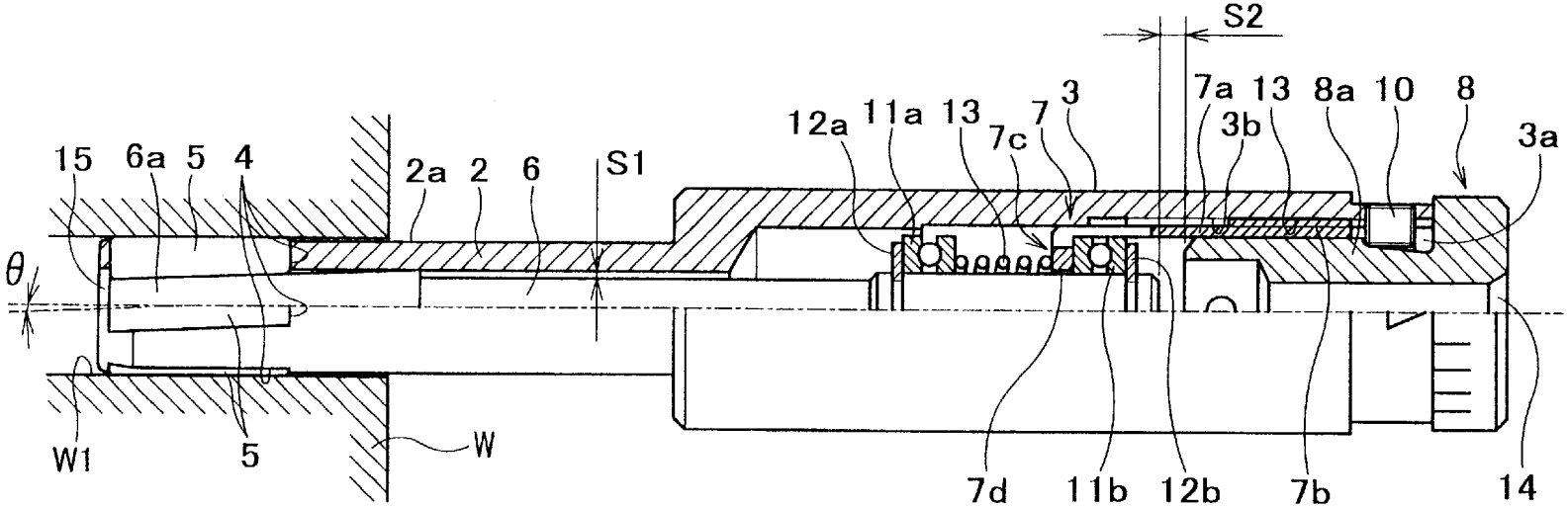
FIG. 2A is a half-sectional view of the roller-burnishing tool.
Figure 2B:
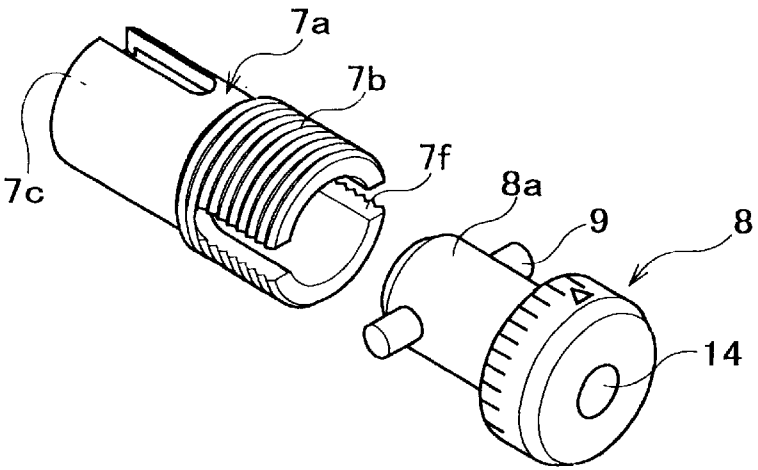
FIG. 2B is a perspective view to indicate the structure of an adjustable screw and an adjustable ring.

Following is the explanation of the implemented formation with reference to FIG. 2 to FIG. 5. FIG. 2 illustrates the roller-burnishing tool with respect to the implemented formation. The main body of the roller burnishing tool 1 consists of the cylindrical frame 2 and the shank part 3, the frame 2 for a rolling compaction processing is coaxially linked with a tip of the cylindrical shank part 3 to be driven by installing in a driving machine (not shown). The grooves 4,4 for engaging multiple rollers are provided in a circumferential direction at regular intervals along the tip of the outer circumference 2*a* of said frame 2, the rollers 5 for rolling compaction machining are engaged with each groove 4,4 in a radial direction with universal function for setting and rolling and rotation. Said grooves 4,4 for engaging the rollers are provided with an incline of a predetermined angle θ relative to the axial line of said frame 2, said rollers 5,5 are engaged with the grooves 4,4 from inside the frame 2 and are supported during the rotation of the tip 6*a* of the mandrel 6 connected with the frame 2 and the shank portion 3. Said mandrel 6 is inserted into the frame 2 and the shank portion 3 from the entry 3*a* opening in the rear end surface of said shank portion 3, the tip 6*a* of the mandrel 6 is a taper shaped gradually decreasing diameter toward a tip side of the frame 2.

The section modulus of said frame 2 and said shank portion 3 is set in accordance with a twist, a bending and a mechanical strength.

A rear of said mandrel 6 is supported by the adjustable screw 7 provided in the rear of said shank portion 3. Floating support of said mandrel 6 is sustained by the clearance S1 in radial direction provided between the outer circumference of the mandrel 6 and the inner circumference of frame 2 and the shank portion 3. In this case, said adjustable screw 7 is formed in a cylindrical shape with a bottom. The male screw 7*b* is relatively fitted with the female screw 3*b* at the inner circumference of said shank part 3 and connects with the cylindrical part 7*a* of the screw main body. The hole for the shaft to sustain the rear of said mandrel 6 is provided with a flange 7*c*. In the cylindrical part 7*a*, the slot 7*f* opens toward the rear of the adjustable screw and is formed for the adjustment of the supporting position for said mandrel 6 by a rotation of this adjustable screw 7. The pin 9 engaged with said slot 7*f* is affixed to the insert shaft portion 8*a* of the adjustable ring 8 inserted into the entry 3*a* of said shank portion 3 as a method to adjust the tool diameter by moving in the axial direction of said frame 2 said mandrel 6. In this case, the insert shaft portion 8*a* of said adjustable ring 8 is fixed to the inner surface of said cylindrical portion 7*a* with universal function for sliding, insertion and withdrawal. Movement and rotation in the axial direction is restricted by the pressing force of the set screw 10 screwed into the rear of the outer circumference of the shank portion 3.

In said mandrel 6, the thrust bearings 11*a*, 11*b* are fixed on a tip side and a rear side of said mandrel 6 by pinching the flange 7*c* of said adjustable screw 7. Locating snap rings 12*a*, 12*b* for the bearings to adjust position along an axial direction of the thrust bearings 11*a*, 11*b* are installed in opposite axial directions of the thrust bearings 11*a*, 11*b*. Moreover the compressing coil spring 13 is equipped as an elastic method to simulate an elastic force between a tip side of a locating snap ring and the flange 7*c* of said adjustable screw 7.

Accordingly, the relative position in an axial direction of the adjustable screw 7 and the adjustable ring 8 are changed by a normal and a reversible rotation of said adjustable ring 8. Specifically, tweaking a predetermined tool diameter is feasible by moving the position of a tip of the taper shaped mandrel 6 for the rollers 5.

Of course, under a no loading condition, in other words, before processing an inner work hole W1 of a work W, keeping the tool diameter of the enveloping circle of said rollers 5,5 at a maximum state is feasible by the set force of said compressing coil spring 13, and preventing the rollers 5,5 in this state from being in a loose condition is also feasible.

An inclined angle (feed angle) θ of said groves 4,4 and a clearance S2 between a rear end surface of the mandrel 6 and a tip end surface of the insert portion 8*a* of the adjustable ring 8 are provided so that said mandrel 6 can be moved from said frame 2 side to said shank portion 3 side to resist impetus of said compressing coil spring 13 when said frame 2 is inserted into a work hole W1 of said work W and is driven in a reversal direction by a rotation drive force of a machine tool. Moreover, in said adjustable ring 8 and the insert shaft portion 8*a*, the passage 14 as a hole or a slit opening between these two surfaces is provided to supply a coolant into said shank portion 3.

Figure 3:
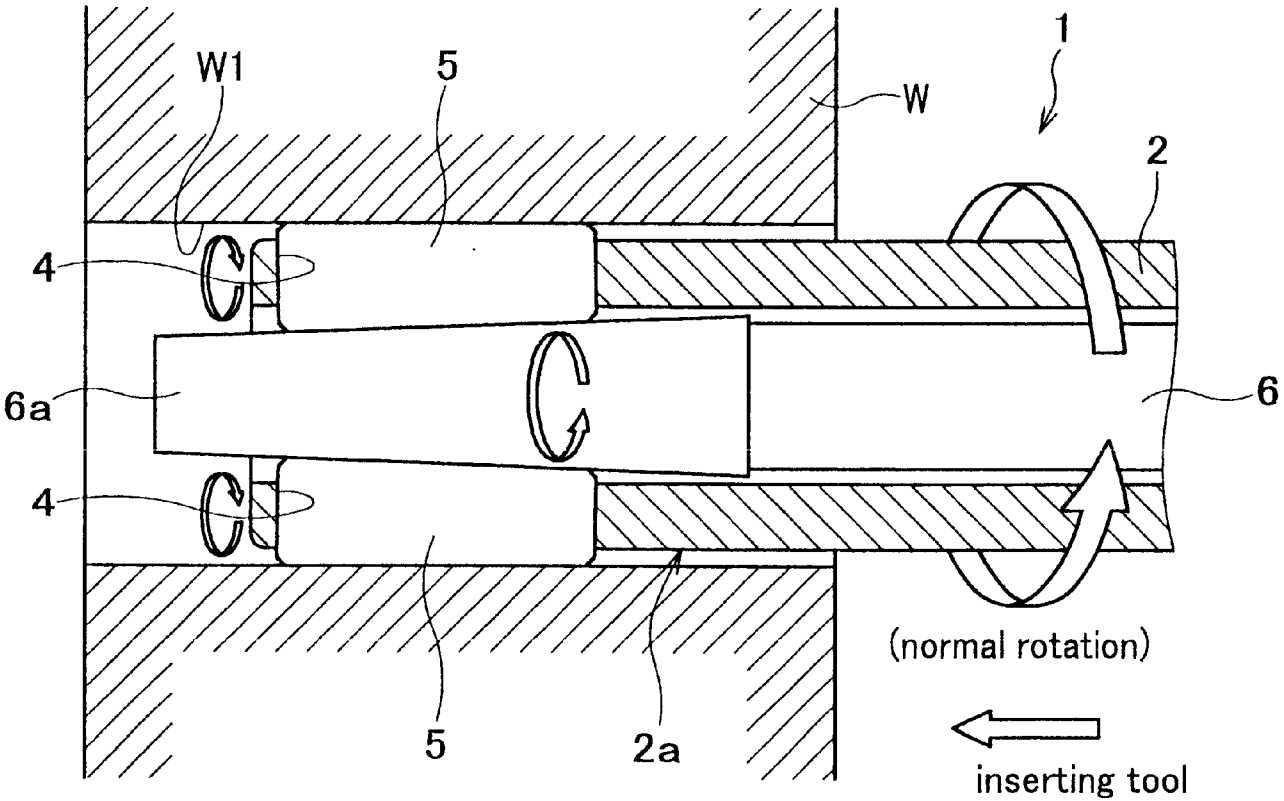
FIG. 3 illustrates the normal direction of rotation and forward moving of roller-burnishing of work holes implementing the roller burnishing tool of this invention.
Figure 4:
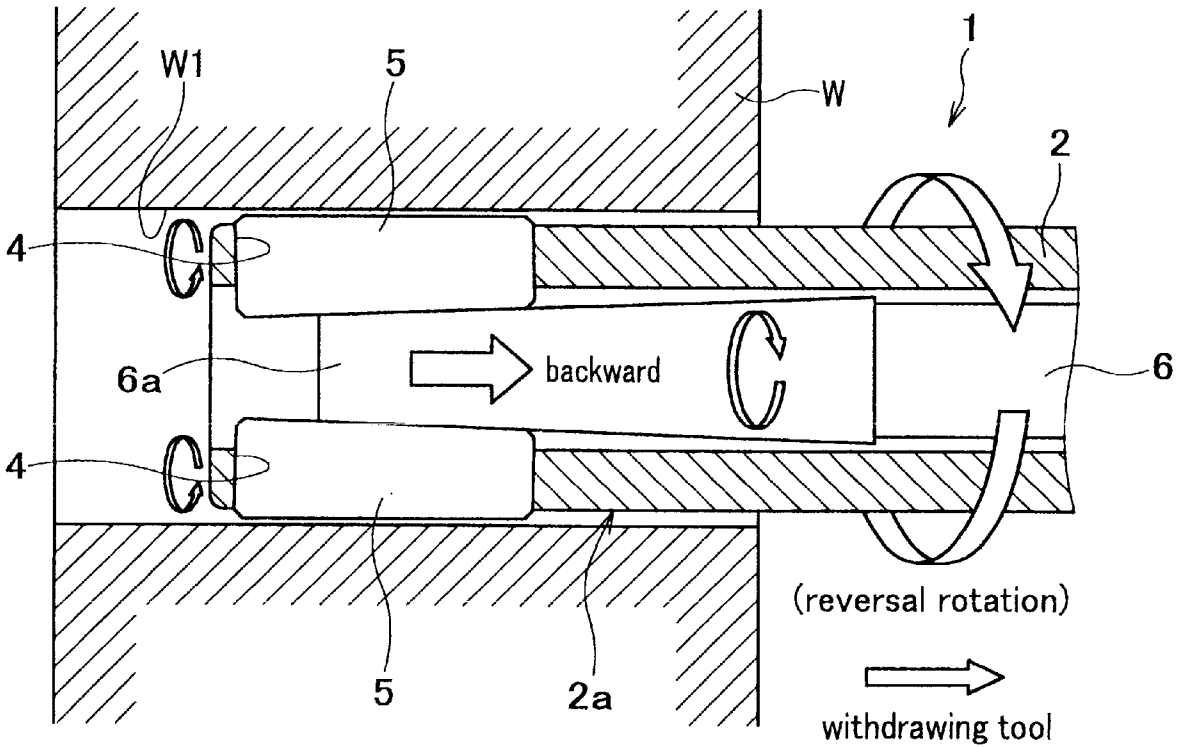
FIG. 4 illustrates withdrawing a roller-burnishing tool from work holes implementing the roller burnishing tool of this invention.

Following is the explanation for the operation of the roller-burnishing tool 1. As illustrated in FIG. 2 and FIG. 3, said frame 2 is inserted into a work hole W1 of work W by imparting a rotary drive in a normal direction. Rollers 5,5 contact an inner surface of a work W1 and an outer circumference of tip 6*a* of the mandrel 6, and begin to rotate by a friction force mutually generated in between. In this time, since said mandrel 6 is supported by said rollers 5,5 and said hole 7*d* of said adjustable screw 7, and is free from a rotary direction, said mandrel 6 dependently rotates in accordance with a rotation of said rollers 5,5.

The compressing spring 13 fitted into the shank portion 3 always pushes the mandrel 6 into the tip side. Consequently, an initial adjustment of a tool diameter in a non load condition is sustained. As illustrated in FIG. 3, however, since the treating force is applied to the mandrel 6 by the action of said feed angle θ, when reversing the rotation of the frame 2, the tool diameter is decreased when the retreating force exceeds the force of the compressing spring 13.

In this way, as a result of the structure for driving the frame 2, rollers 5,5 perform a rapid feed processing 3–4 times faster than the conventional structure for driving a mandrel. Specifically, by the principle of planetary movement, when comparing imparting a rotary motion to the conventional mandrel 114 at 1000 revolutions/minute with when imparting a rotary motion to the frame 2 of this invention at 1000 revolutions/minute, the feeding speed of this inventive one is 3–4 times faster, because process completions are increased. Of course as mentioned previously, as a result of the structure to perform a rotary driving of the frame 2, there is high rigidity compared with the conventional structure of driving the mandrel 114. As a result of the structure of coaxially positioning the mandrel 6 in an axis of the frame 2, there is improved rotation accuracy and a capability for rapid rotation. Accordingly the whole efficiency improves 6–7 times as much as the conventional one.

Further, as previously mentioned, under the condition of performing a rotary drive of the roller-burnishing tool 1, even though the rotary speed of the mandrel 6 is increased, the rotation is smooth due to it being supported by a pair of thrust bearings 11*a*, 11*b*.

Figure 5:
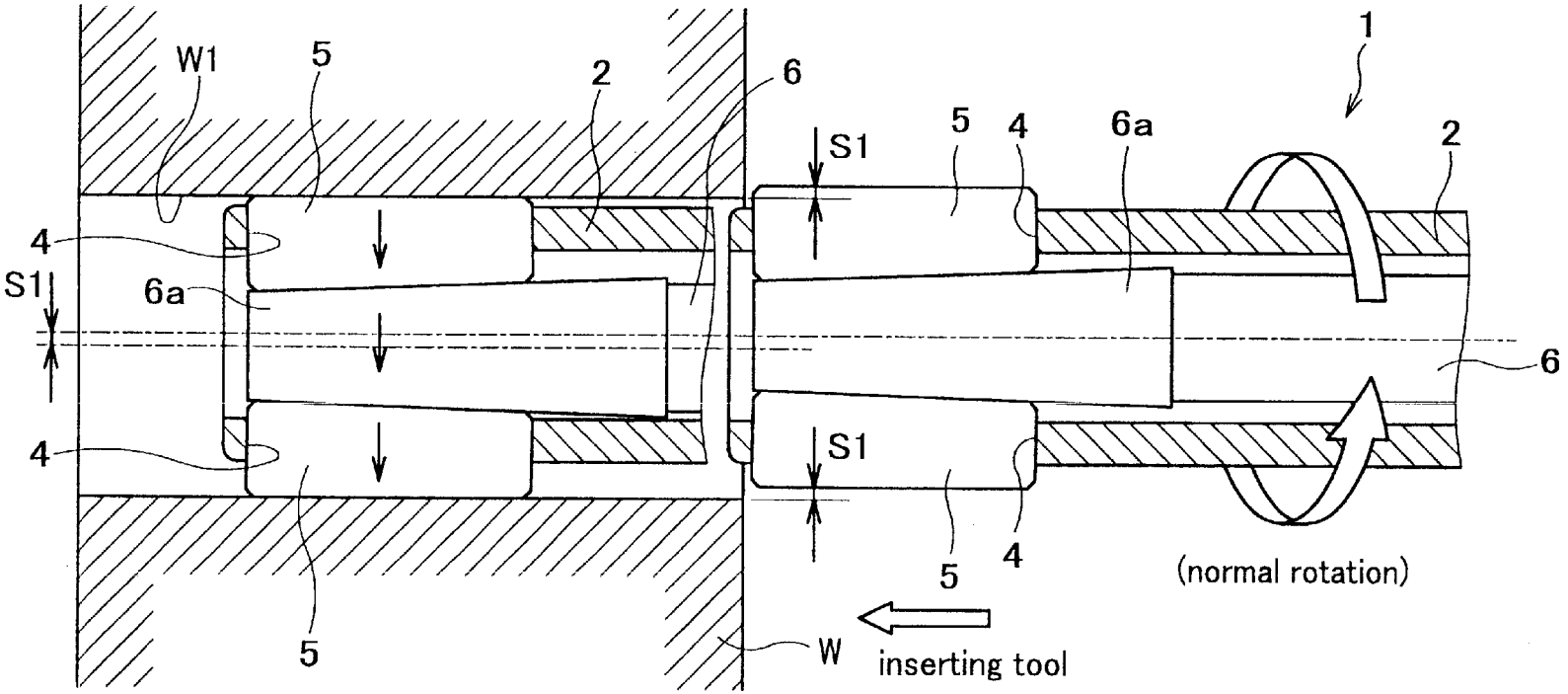
FIG. 5 illustrates absorbing an eccentricity of the roller burnishing tool for work holes implementing the roller burnishing tool of this invention.

As FIG. 2 indicates, said mandrel 6 is not restricted in a radial direction, and also as FIG. 5 indicates, mandrel 6 is supported by floating in the clearance between an inner diameter of the frame 2 and an outer diameter of the mandrel 6. When processing the inner surface of work hole W1 by performing a rotary driving of the roller burnishing tool 1, as FIG. 5 indicates, the core difference of both the roller burnishing tool 1 and the work hole W1 does not cause a deterioration of the formal accuracy. Therefore, more sophisticated completion of work hole 1 is feasible.

Moreover, since tweaking a tool diameter does not cause a removal of roller 5,5 in a radial direction, processing hook holes are effective. Specifically, in case of processing hook holes on the conventional roller-burnishing tool 111, whenever changing a tool diameter, tweaking a tip point forward of a driving machine is necessary. But in the case of roller burnishing tool 1, the stroke of the driving machine is a constant and tweaking is unnecessary since the position of rollers 5,5 is invariable.

Moreover, connecting the oil coolant supplied from the center spindle of a driving machine (not illustrated) with said passage 14 allows the oil coolant to gush out from the aperture 15 of a tip frame and each groove 4 for engaging a roller without leaking to the outside on the way. That is why, since an excellent lubricant condition is guaranteed, and since processing the inner hole with cooling and lubrication is feasible, more sophisticated mirror finishing is practicable.

In accordance with above discussion of the invention, the present invention displays the following excellent effects.

(1) Since adjustment means and elastic means to adjust a tool diameter can be installed in the inside of the frame and the shank portion, the whole range from the shank portion to the forward frame is subject to be the effective processing length. Accordingly, the inventive tool can be installed in a small driving machine which has restrictions for a protruding length of a tool such as a small machining center or NC lathe.

(2) As a result of the structure for driving the frame, compared with the conventional system of driving the mandrel, a rapid feeding process is feasible. Moreover, the rigidity of the whole tool is improved due to the structure to perform the rotary drive of the frame. In addition, since the shank portion is coaxially connected with the frame, the rotation accuracy is improved and a significant improvement of the whole efficiency is practically possible.

(3) The mandrel is not restricted in a radial direction, since providing clearance between an inner surface of the frame and an outer surface of the mandrel allows the mandrel to float. As a result sophisticated completion is possible without deteriorating formal accuracy even under the condition of the core difference between a tool and a work hole.

(4) As a result of the structure to adjust a tool by moving a taper shaped mandrel in an axial direction and to prevent the position of rollers from moving, it is easy to process hook holes.

(5) The structure is compact and small which reduces the quantity of parts and leads to less expense.

What is claimed is:

1. A roller burnishing tool for mounting to a rotary driving machine, comprising:

a main body having a cylindrical frame and a shank portion, said cylindrical frame having a plurality of grooves at regular intervals on a circumference, said shank portion for mounting to said rotary driving machine;

a plurality of rollers engaged in said grooves;

a mandrel having a taper-shaped tip, said mandrel contained within said main body to support with said taper-shaped tip said rollers in said grooves;

an elastic member adapted to hold said mandrel against said rollers thereby adjusting said rollers radially; and a ring fixed to said shank portion, said ring being axially movable to adjust said mandrel axially;

wherein said tool is mounted to said rotary driving machine at said shank portion so that said tool is short in length; and wherein said tool is adjustable with said elastic member and said ring.

2. The roller burnishing tool of claim 1 wherein said tool has a first rotation axis and each of said rollers have a second rotation axis and wherein said grooves and said second rotation axis of said rollers have a feed angle relative to said first rotation axis, so that said mandrel easily moves in a direction from said frame toward said shank portion when rotation of said main body is reversed relative to a processing rotation.

3. The roller burnishing tool of claim 1 wherein said frame has an inner surface and said mandrel has an outer surface, said tool having a clearance between said inner surface of said frame and said outer surface of said mandrel to allow said mandrel to float within said main body.

4. A roller burnishing tool for mounting to a rotary driving machine, comprising:

a main body having a cylindrical frame and a shank portion, said cylindrical frame having a plurality of grooves at regular intervals on a circumference, said shank portion for mounting to said rotary driving machine;

a plurality of rollers engaged in said grooves;

a mandrel having a taper-shaped tip, said mandrel contained within said main body to support with said taper-shaped tip said rollers in said grooves;

means for biasing said mandrel against said rollers; and means for adjusting said biasing means axially;

wherein said tool is adjustable with said adjusting means and said biasing means.

* * * * *